United States Patent [19]

Saul

[11] Patent Number: 5,022,189

[45] Date of Patent: Jun. 11, 1991

[54] SANDER EXTENSION DEVICE

[76] Inventor: Earl W. Saul, One Silver Ave., Glassboro, N.J. 08028

[21] Appl. No.: 492,078

[22] Filed: Mar. 12, 1990

[51] Int. Cl.[5] ..... B24B 23/04

[52] U.S. Cl. ..... 51/170 TL; 51/170 MT

[58] Field of Search ..... 51/170 TL, 170 MT, 170 R, 51/358, 391, 406, 407, 401

[56] References Cited

U.S. PATENT DOCUMENTS

| | | | |
|---|---|---|---|
| 2,307,431 | 1/1943 | Tilden et al. | 51/107 TL |
| 2,332,613 | 10/1943 | Swank | 51/170 TL |
| 4,802,310 | 2/1989 | Holmes | 51/170 MT |

FOREIGN PATENT DOCUMENTS

| | | | |
|---|---|---|---|
| 921642 | 5/1947 | France | 51/170 TL |

*Primary Examiner*—Maurina Rachuba

*Attorney, Agent, or Firm*—Z. T. Wobensmith, III

[57] ABSTRACT

A sander extension device for attachment to an oscillating or vibrating sander, for sanding convex or concave surfaces, which device includes a cushioned flexible metallic strip to which a strip of sandpaper is detachably secured, the metallic strip is capable of being manually or fixedly guided to conform to the desired contours of the article being sanded.

2 Claims, 2 Drawing Sheets

SANDER EXTENSION DEVICE

BACKGROUND OF THE INVENTION

1. Field of the Invention

This invention relates to a sander extension device of the type that is intended to be attached to an oscillating or vibrating sander.

2. Description of the Prior Art

Devices for attachment to sanders of the oscillating or vibrating type, to enable the user to sand objects or areas on objects that can not satisfactorily be done by the sander alone, are known in the art. Examples of such devices are shown in U.S. Pat. Nos. 2,307,431; 3,796,013; 4,768,310; 4,802,310 and the French Pat. No. 77-07209. Such devices cause flat spots, and are not satisfactory for use in sanding curved or intricate surfaces, such as are often encountered in wood sculptures. The delicacy of the features and the multiplicity of small concave or complex surfaces requires a degree of control and touch not available with the prior art. The device of the invention permits of controlled sanding of both concave and convex areas and provides other advantages.

SUMMARY OF THE INVENTION

A sander extension device for attachment to an oscillating or vibrating sander, which comprises a cushioned flexible metallic strip, with a strip of sand paper secured thereto and which can be manually or fixedly guided to conform to concave or convex surfaces, to accurately sand curved and intricate surfaces.

The principal object of the invention is to provide a sander extension device which permits of accurate sanding of convex and concave surfaces.

A further object of the invention is to provide a device of the character aforesaid which is simple and inexpensive to construct but durable and long lasting in use.

A further object of the invention is to provide a device of the character aforesaid which is simple and easy to use.

A further object of the inveniton is to provide a device of the character aforesaid which can be easily attached and detached.

A further object of the invention is to provide a device of the character aforesaid wherein a strip of sand paper can be easily attached and detached.

Other objects and advantageous features of the invention will be apparent from the description and claims.

DESCRIPTION OF THE DRAWINGS

The nature and characteristic features of the invention will be more readily understood from the following description taken in connection with the accompanying drawings forming part hereof in which.

Figure 1:
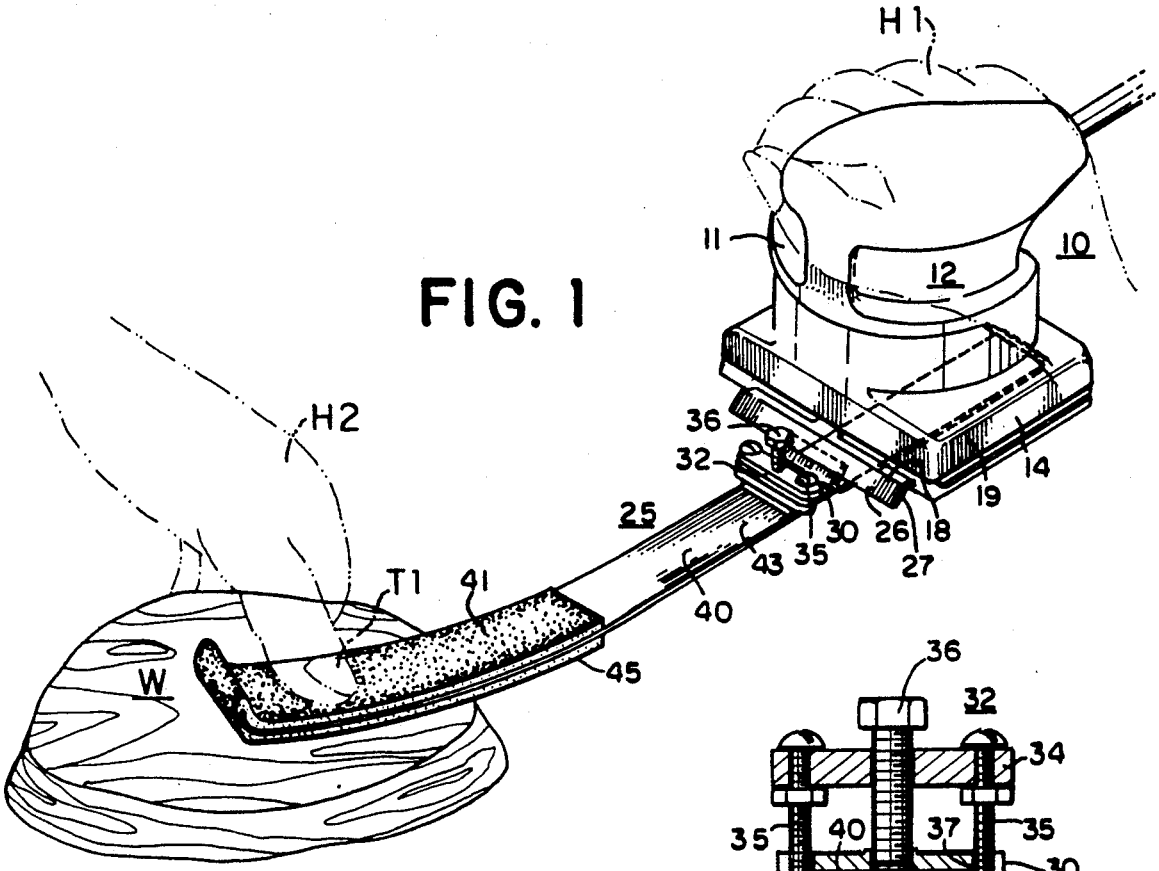
FIG. 1 is a view in perspective of one embodiment of the sander extension device attached to an oscillating sander.
Figure 4:
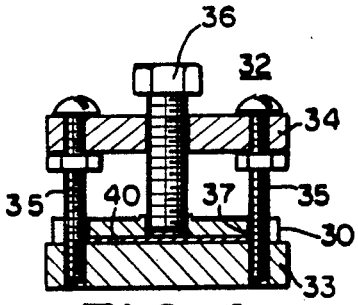
FIG. 4 is a vertical sectional view taken approximately on the line 4—4 of FIG. 3.
Figure 5:
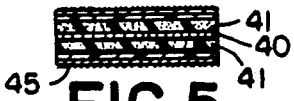
FIG. 5 is a vertical sectional view taken approximately on the line 5—5 of FIG. 3.
Figure 2:
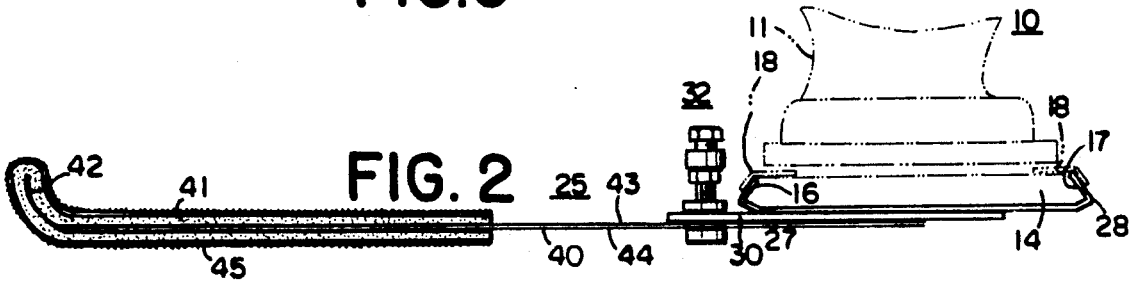
FIG. 2 is a side elevational view of the device of FIG. 1.
Figure 3:
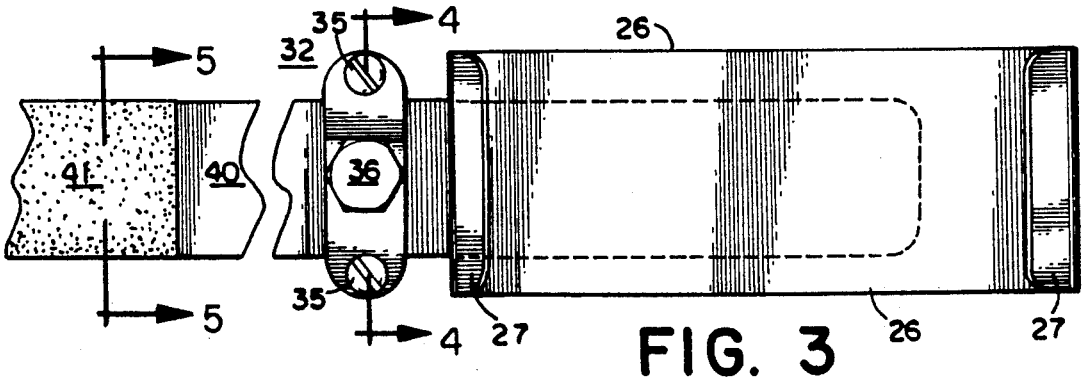
FIG. 3 is a fragmentary top elevational view, enlarged, of a portion of the device of FIG. 1.

It should, of course, be understood that the description and drawings herein are illustrative merely and that various modifications and changes can be made in the structure disclosed without departing from the spirit of the invention.

Like numerals refer to like parts throughout the several views.

DESCRIPTION OF THE PREFERRED EMBODIMENTS

Referring now more particularly to the drawings and FIGS. 1 to 5, inclusive, an oscillating or vibrating sander 10 of well known type is illustrated, and which can be a palm sander available from Sears, Roebuck & Co., Chicago, Ill.

The sander 10 has a hand grip 11, body 12 and pad 14 which pad is urged in horizontal oscillating or vibrating motion by a motor (not shown) in body 12. The pad 14 is of square configuration with beveled edges 16 and 17 at its front and back. Clamps 18 are provided to grip sandpaper (not shown) at edges 16 and 17 and are actuated by handles 19. The sander extension device 25 has a mounting bracket 26, which includes front and rear walls 27 and 28, which engage the beveled edges 16 and 17, and which are retained thereto by the clamps 18. The bracket 26 has a plate 30 attached thereto, which extends forward and has a clamping device 32 with lower plate 33, and upper plate 34 which plates are held together by bolts 35. The upper plate 34 has a cap screw 36 therein and in hole 37 in plate 30. A strip 40 is provided of rectangular configuration and retained between plate 30 and lower plate 33 by pressure from cap screw 36.

The strip 40 is preferably constructed of metal, such as brass or copper, which is resilient and is provided with a pad of cushioned material 41 extending over and end 42, and the top and bottom sides 43 and 44, and is adhesively secured to strip 40. A strip of sandpaper 45 is illustrated on side 44, of any well known desired type, depending on the material to be sanded. The sandpaper strip 45 can be secured to pad 41 by any number of well known strippable adhesives, that permit attachment and subsequent removal of the strip 45 when replacement is required.

Figure 6:
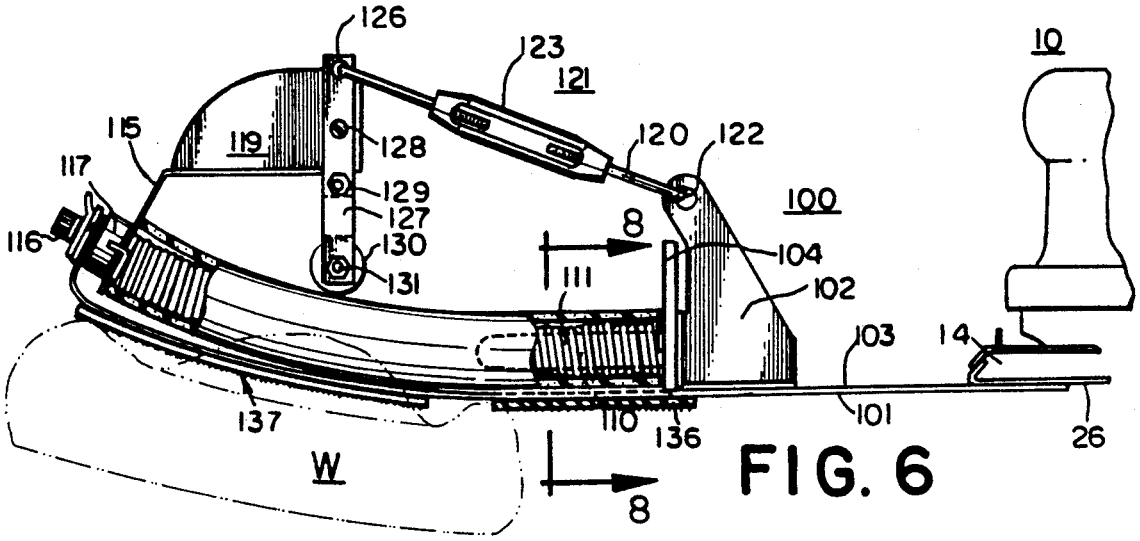
FIG. 6 is a side elevational view of another embodiment of sander extension device attached to an oscillating sander.
Figure 7:
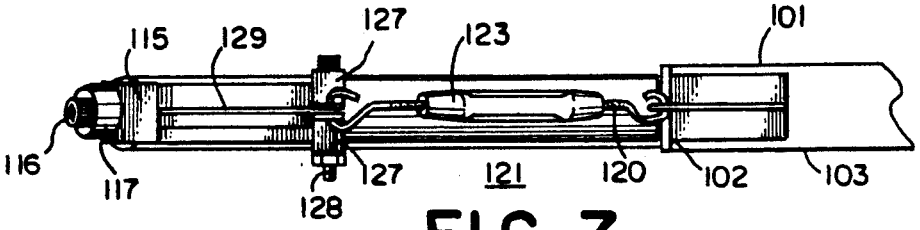
FIG. 7 is a fragmentary top elevational view, enlarged, of a portion of the sander extension device of FIG. 6.
Figure 9:
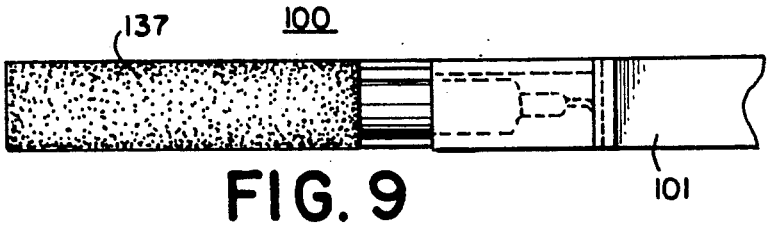
FIG. 9 is a bottom view of a portion of the device of FIG. 6.
Figure 8:
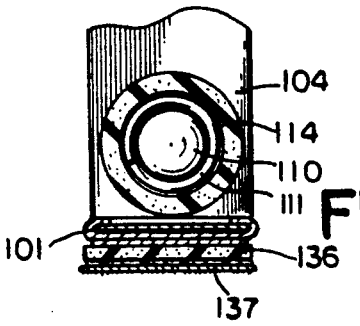
FIG. 8 is a vertical sectional view, enlarged, taken approximately on the line 8—8 of FIG. 6.

Referring now more particularly to FIGS. 6 to 8 another embodiment of sander extension device 100 is illustrated, which is attached to a sander 10 as described above. The device 100 includes a bracket 26 engaged with pad 14, and has a strip 101 attached thereto, extending forwardly from sander 10 as shown in FIG. 6.

The strip 101 is preferably constructed of metal such as brass or copper, which is resilient and capable of limited bending. A rear bracket 102 is fastened to strip 101 on its upper face 103. A plate 104 is attached to bracket 102 in front of the bracket 102 and also fastened to strip 101. A bolt 110 is engaged in plate 104 and with a coiled spring 111 to retainthe spring 111 to plate 104. The spring 111 is enclosed in a resilient casing 114, and secured at its other end by bolt 116 and nut 117 to a plate 115 of a front bracket 119. The bracket 119 is also fastened to strip 101. The bracket 102 has one end of a threaded rod 120 of a turn buckle assembly 121 engaged in a hole 122 in bracket 102, with a turnbuckle nut 123 engaged with rod 120 and another threaded rod 125, which rod 125 is engaged in hole 126 in arms 127. The arms 127 are rotatably carried by pin 128 on plate 129 of bracket 119, and retained together by bolts 129. The arms 127 at the end opposite to hole 126 carry a wheel 130 on bolt 131. The wheel 130 has a central groove (not shown) which engages the casing 114, and is moved therealong by the turnbuckle assembly to be described.

The strip 101 on its bottom face 135 has a cushioning pad 136 fastened thereto, and extending therealong under and between the brackets 102 and 119. A strip of sandpaper 137 is detachably secured to pad 136 by strippable adhesive of well known type, to permit of attachment and removal for replacing the strip 137 when required.

The mode of operation will now be pointed out.

Referring to FIGS. 1 to 5, and when it is desired to sand an object the desired grade of sandpaper strip 45 is secured to bottom side 44 of strip 40, and sander 10 is activated. The user grips sander 10 in one hand H1 and places the strip 45 over the work W to be sanded. The user places a thumb T1 from the other hand H2 on the pad 41 and presses the strip 40 and sandpaper 45 onto the work W. Due to the resiliency of strip 40 the strip will bend to accomodate the contours of the work and accurate guided sanding occurs. It should be noted that this embodiment works equally well for both concave and convex surfaces.

Referring now to FIGS. 6 to 8 the other embodiment of sander extension device 100 has the turnbuckle assembly 121 adjusted to cause arms 127 to rotate about pin 128, pulling bracket 119 and the end of strip 101 upwardly, so that the strip is caused to curve to the amount desired to accommodate a concave surface CS of Work W to be sanded. A strip of sandpaper 137 is secured to pad 136, sander 10 is activated and gripped by the user and sanding occurs. The angle of curvature can be varied by adjusting the assembly 121 turnbuckle as required.

It will thus be seen that sander extension devices have been provided with which the objects of the invention are achieved.

I claim:

1. A sander extension device for attachement to a sander of the type which sander is engaged by one hand of a user and has a motor driven pad which moves in an oscillating or vibratory motion with clamps to retain a strip of sandpaper for sanding surfaces of an object, which device permits of sanding intricate surfaces of the object at a distance from the sander and which comprises a mounting bracket for attachment and retention to said pad by said clamps resilient strip means having a top and a bottom surface engaged with said bracket, means engaged with said strip means to cause it to conform to said surface to be sanded.

said means to conform includes cushioning material on said top surface for engagement by at least one finger of the other hand of the user, and cushioning material on said bottom surface of said strip means, and a strip of sandpaper secured to said bottom surface of said cushioning material.

2. A device as claimed in claim 1 in which said sandpaper is secured to said bottom surface of said cushioning material by strippable adhesive.

* * * * *